United States Patent [19]

LeGlue et al.

[11] Patent Number: 4,478,389

[45] Date of Patent: Oct. 23, 1984

[54] JACKING APPARATUS ADJUSTABLE FOR ALIGNMENT VARIATIONS

[75] Inventors: Michael J. LeGlue, New Orleans; Nico deBoer, Kenner, both of La.

[73] Assignee: McDermott Incorporated, New Orleans, La.

[21] Appl. No.: 331,860

[22] Filed: Dec. 17, 1981

[51] Int. Cl.[3] ..... B66F 1/04

[52] U.S. Cl. ..... 254/108

[58] Field of Search ..... 254/105, 108–111, 254/93 R, 93 H, 93 HP; 91/216 R, 216 A, 216 B; 92/117 R, 117 A, 146

[56] References Cited

U.S. PATENT DOCUMENTS

| | | | |
|---|---|---|---|
| 2,163,959 | 6/1939 | Nilson | 92/117 R |
| 3,659,823 | 5/1972 | Griffin | 254/105 |
| 3,986,246 | 10/1976 | Gemmill | 254/93 HP |
| 4,007,915 | 2/1977 | Chambers | 254/108 |
| 4,014,266 | 3/1977 | Naslund et al. | 254/105 |
| 4,030,699 | 6/1977 | Heinke | 254/108 |
| 4,212,450 | 7/1980 | Lambert | 254/108 |
| 4,234,163 | 11/1980 | Kormendy | 254/108 |

*Primary Examiner*—Robert C. Watson

*Attorney, Agent, or Firm*—Robert J. Edwards; James C. Simmons

[57] ABSTRACT

A jacking apparatus for application of force to at least two anchor points for movement of a load. The force is transmitted through fluid in at least two equalizing cylinders after which it is transmitted to the anchor points. The fluid pressure in each of the equalizing cylinders is limited to a predetermined value to provide equal distribution of the load between all of the anchor points to which the jacking apparatus is or should be engaged.

19 Claims, 8 Drawing Figures

JACKING APPARATUS ADJUSTABLE FOR ALIGNMENT VARIATIONS

This invention relates to a jacking apparatus for movement of loads. More particularly, this invention relates to a jacking apparatus which applies force to at least two anchor points for movement of a load.

At various times during industrial projects there exists a need to move heavy loads from one location to another. For example, in marine applications, it may be desirable to move a heavy boat along launchways for launching into the water. In such a case, a jacking apparatus utilizing hydraulic cylinders to generate the force necessary for movement of such a load may be used. In a typical jacking arrangement, the load may be connected through various interconnecting structure to a piston rod which piston rod is also attached at the opposite end thereof to a piston which is contained within a double-acting cylinder. The cylinder may be anchored at one or more anchor points in or on the structure supporting the apparatus to prevent its movement in a direction opposite to the direction of desired movement of a load for a power stroke of the piston whereby hydraulic fluid pressure is applied on one side of the piston and movement of the load is effected by the resulting movement of the piston. For repositioning of the jacking apparatus for another power stroke, hydraulic fluid pressure is typically applied to the piston on the opposite side thereof and the anchor points are disengaged whereby the load, being heavier or being anchored against movement, remains stationary and the jacking apparatus is moved a distance in the desired direction of movement of the load equal to about the same distance that the load was moved on the power stroke. At this point another set of anchor points is engaged thereby readying the apparatus for another power stroke wherein the load may be moved another finite distance in the desired direction.

A typical anchor point may be a slot in the support structure which is engaged by a dog in the apparatus for anchoring the apparatus. In a typical jacking apparatus, two or more anchor points may be engaged by dogs simultaneously for application of force for a power stroke. These anchor points may, however, occasionally not be sufficiently aligned for simultaneous engagement by the dogs. As a result, one or more dogs may not engage the respective anchor points for a power stroke and the remaining anchor point or anchor points are forced to assume the entire load. This may cause deformation of the affected anchor points and/or the dogs. Jamming of the dogs in the anchor points may result causing costly downtime for replacement of dogs and/or repairs to the structure in which the anchor points are located.

In the marine field, offshore oil platforms have become progressively heavier. As a result, the capacity requirements of jacking apparatus for launching such platforms have become increasingly greater. For example, a jacking apparatus may be provided with two or more hydraulic cylinders arranged in tandem to provide greater amounts of force within certain size constraints. Due to the greater load requirements, it may be necessary that the rails in which the anchor points are provided be made of expensive high tensil steel (more than 50 kilopounds/sq.in.). If excessive force is applied to this steel at an anchor point, it may become brittle and be ruined. In such a case, an entire rail may require replacement.

A huge offshore oil platform requiring the use of a jacking apparatus may weigh 28,000 tons or more and require a jacking force of 3,000 tons or more. Such requirements may substantially increase in the future. A jacking apparatus for movement of such a load may require application of force against four or more anchor points. As the quality and cost of materials for such jacking apparatus increases, it becomes more and more expensive to replace or repair anchor point rails or dogs should they become ruined due to inadequate equalization of the load between the anchor points. It is, therefore, desirable to provide in such a jacking apparatus a means whereby the load applied to the anchor points can be equalized such that each anchor point consistently assumes its share of the total load.

It is therefore an object of this invention to provide a jacking apparatus wherein the load is equally distributed between all of the anchor points to which it is or should be engaged.

The above and other objects, features, and advantages of this invention will be apparent in the following detailed description of the preferred embodiments thereof which is to be read in connection with the accompanying drawings.

Figure 1:
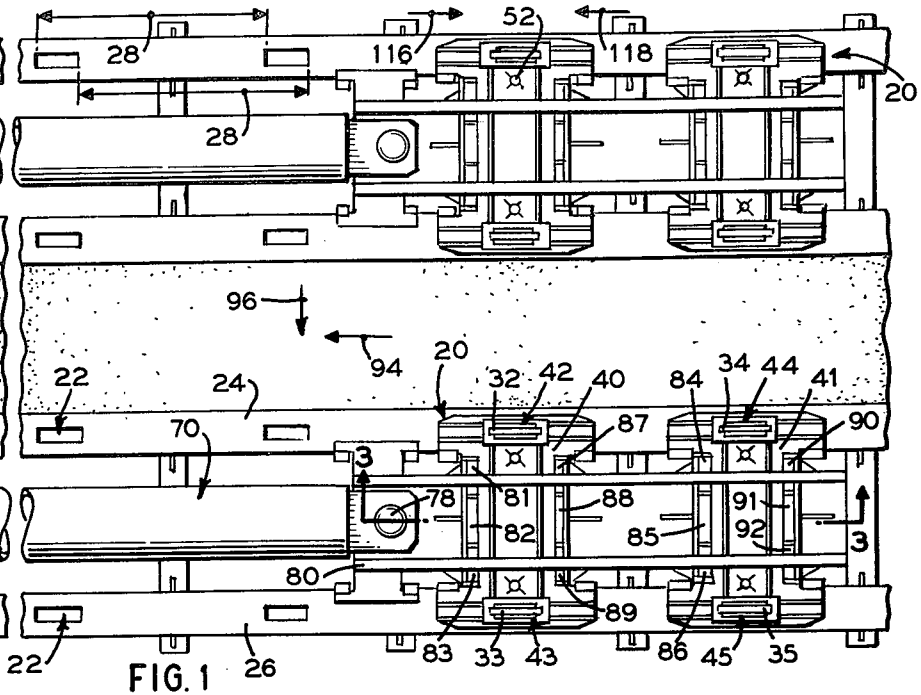
FIG. 1 is a plan view of a jacking apparatus which embodies this invention.
Figure 2:
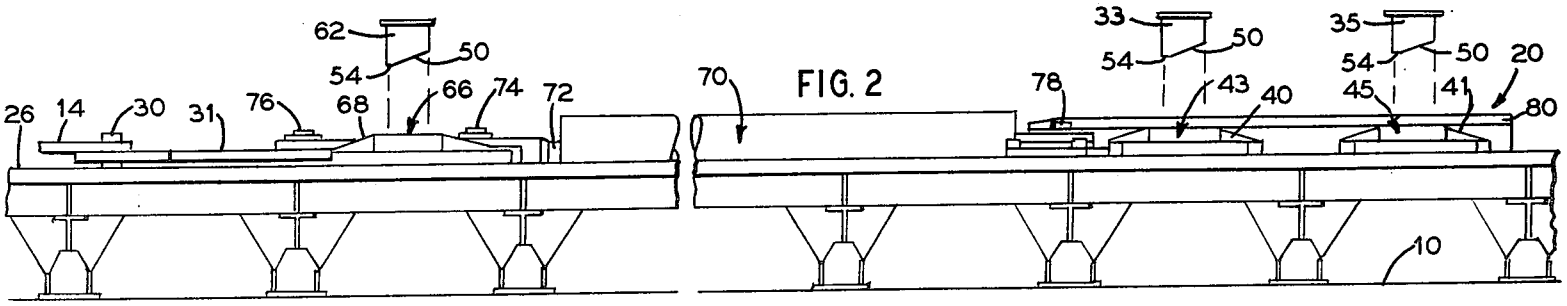
FIG. 2 is an elevation view thereof.

Referring to FIGS. 1 and 2, there is shown a barge deck 10 upon which is erected a support structure such as a set of launchways 12 (only one of which is shown) for supporting and moving a load 14 such as a boat or offshore oil platform. The launchways 12, which may have surfaces composed of a material such as Teflon resin having a low coefficient of friction to aid in sliding movement of a load, extend in a direction of desired movement of the load 14 (either from left to right or from right to left in FIGS. 1 and 2). Each launchway 12 supports a pair of jacking apparatus 20 as well as the load 14 for sliding movement therealong. A plurality of anchor points such as slots 22 vertically oriented in the support structure such as in jacking beams 24 and 26 provide a means for anchoring each jacking apparatus 20 against movement during a power stroke thereof. Jacking beams 24 and 26 preferably extend alongside of and are preferably slightly higher than the respective launchway 12 to aid in guiding the load 14. Corresponding edges of the slots 22 of each beam are spaced apart in the longitudinal direction (a direction of desired movement of a load) a distance illustrated at 28 in FIG. 1 which is approximately equal to the length of a power stroke of the respective jacking apparatus 20. However, this distance 28 may typically vary by a small amount along the launchways 12 from one pair of slots 22 to another. Since each jacking apparatus 20 is substantially identical and is connected to a common load for operation in substantially the same manner, only one jacking apparatus will be described hereinafter. Means such as pin 30 and connecting member 31 are provided for engaging the load 14 by the jacking apparatus 20. A load engagement means may of course comprise any kind of engaging mechanism by which the jacking apparatus 20 may engage a load for movement in a desired direction. For example, a ram may be provided for pushing a load.

Shear members (not shown) may be welded to the deck 10 to transmit the jacking force from the launchways 12 to the deck. A launchway support may then be set between a pair of longitudinally-spaced shear members and restrained from vertical movement by hold-down members (not shown) which allow movement of the launchway support longitudinally to make contact with a shear member. The shear member then restrains the support against further longitudinal movement. The use of shear members thus simplifies the process of attachment of launchways to a deck and the disengagement thereof from a deck for attachment at another location on the deck.

Anchor point engagement means such as dogs 32 through 35 removably contained in one or more members such as housings 40 and 41 are provided on the jacking apparatus 20 to engage respective anchor points 22 on the beams 24 and 26 to restrain the jacking apparatus 20 from movement for movement of the load 14 when force is applied at anchor points 22 in one direction and to disengage the respective anchor points 22 for movement of the jacking apparatus 20 when force is applied at anchor points 22 in the opposite direction. As shown in FIG. 2, wherein dogs 33 and 35 are shown removed from respective housings 40 and 41 are oriented for insertion in respective housing apertures 43 and 45, these dogs 32 through 35 may be characterized by longitudinally beveled bottom surfaces 50. Conventional gin pole sockets 52 may be provided for mounting of hoisting apparatus (not shown) to assist in removing and inserting the dogs. These dogs 32 through 35 may be inserted into the respective apertures with the lowest points 54 of the bottom surfaces 50 located nearest the load 14, as illustrated in FIG. 2, and with substantial portions of the respective bottom surfaces 50 thereof inserted beyond the bottoms of the respective housings 40 and 41 and into engagement with respective anchor point slots 22 to provide resistance to movement of the jacking apparatus 20 in a direction toward the load 14 so that movement of the load 14 may be effected in the direction illustrated at 56. Inserted as illustrated in FIG. 2, the dogs 32 through 35 do not, however, resist movement of the jacking apparatus 20 in the direction 56 when force is applied to urge the jacking apparatus 20 in that direction. Instead, the dogs disengage from the slots 22 and slide along or over the surface of the beams 24 and 26 to engage another set of slots 22 longitudinally spaced therefrom. The dogs 32 through 35 may also be rotated 180° from the orientation illustrated in FIG. 2 before insertion into the respective apertures 42 through 45 and slots 22 so that the lowest portions 54 are furthest from the load 14 to provide resistance to movement of the jacking apparatus 20 in a direction away from the load 14 so that movement of the load 14 may be effected in the direction illustrated at 58. Although one type of anchor point and anchor point engagement means is described herein, other types may be provided, and these are also meant to come within the scope of this invention. For example, rack and pawl or caliper systems may be provided.

In a situation where the jacking apparatus 20 is being utilized to push a load 14 such as in direction 58 in FIG. 1, it may be desirable to not attach the apparatus 20 to the load 14. In other words, the load 14 would remain free of any attachment to the jacking apparatus 20 and be pushed by a ram. In such a case, dogs 32 through 35 may be inserted into respective apertures of housings 40 and 41 and corresponding slots 22 with the lowest points 54 of the respective bottom surfaces 50 furthest from the load 14. During a power stroke, cylinder structure 70 (except for pistons and piston rods therein) may be held stationary by dogs 32 through 35 while the load 14 may be pushed by hydraulic pressure against the pistons (not shown) in direction 58. In accordance with such an embodiment, piston rod portion 72 of hydraulic cylinder structure 70 is connected to one side of another housing 68 through means of pin 74. Removable dogs 60 and 62, similar to dogs 32 through 35, are inserted in respective apertures 64 and 66 in housing 68. These dogs 60 and 62 may be inserted into housing 68 and respective slots 22 with the lowest points 54 of their respective bottom surfaces 50 furthest from the load 14 to provide a means for anchoring the piston rod structure 72 against movement on a repositioning stroke when the load 14 is not attached to the piston rod structure 72 or when the load 14 is too light to otherwise anchor the piston rod structure 72 against movement. Housing 68 may be connected to the load 14 through pin 76 for transmitting the force between the piston rod portion 72 and the load 14.

Force generating means such as the main hydraulic cylinder structure 70, which may include one or more double-acting hydraulic cylinders, provides force for application against anchor points to anchor the jacking apparatus 20 for movement of a load 14. Such an hydraulic cyinder structure for jacking apparatus is commonly known to those of ordinary skill in the art to which this invention pertains.

Figure 3:
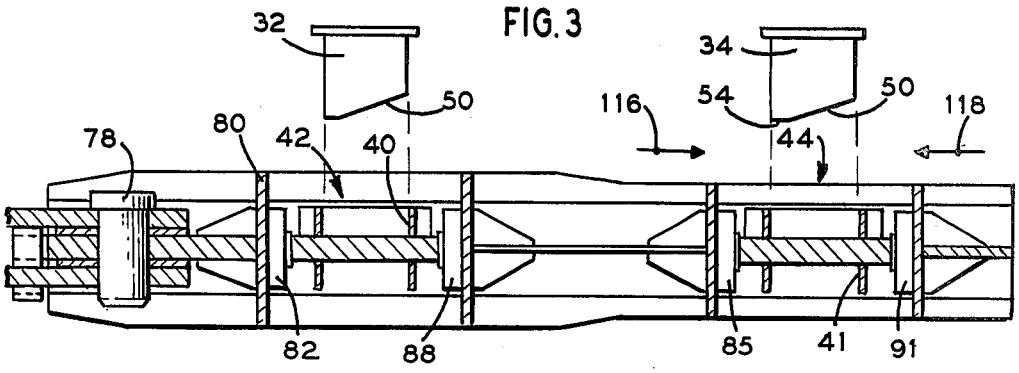
FIG. 3 is an enlarged section view thereof taken along line 3—3 of FIG. 1.

In accordance with this invention, force transmission means is provided for transmitting the force generated by the main hydraulic cylinder structure 70 through fluid contained in two or more hydraulic cylinders 81 through 92 to anchor points 22. For the purposes of distinguishing them from the main hydraulic cylinder structure 70, the hydraulic cylinders 81 through 92 will be called "equalizing cylinders" in this specification and in the claims. In accordance with a preferred embodiment of this invention, the force generated by the main hydraulic cylinder structure 70 is transmitted, as best shown in FIG. 3, through pin 78 to frame 80, then through two or more of the equalizing cylinders 81 through 92 to one or more respective housings 40 and 41 which then transmit the force by means of two or more dogs 32 through 35 to respective anchor points 22.

Housing 40 extends between the jacking beam 24 and 26 and is provided with a pair of dogs 32 and 33 which are spaced apart in a transverse direction of the apparatus 20 to engage corresponding slots 22 in jacking beams 24 and 26 respectively. For the purposes of this specification and the claims, a "transverse direction" is defined as a direction perpendicular to a longitudinal direction, and a "longitudinal direction" is defined as a direction of movement of a load by the jacking apparatus during application of force against anchor points. A longitudinal direction is illustrated at 94 and a transverse direction is illustrated at 96 in FIG. 1. Housing 41, which also extends between the jacking beams 24 and 26 and which is spaced apart in a longitudinal direction 94 of the apparatus from housing 40, is also provided with a pair of dogs 34 and 35 which are spaced apart in a transverse direction 96 of the apparatus to engage corresponding slots 22 in jacking beams 24 and 26 respectively. Dogs 32 and 33 are spaced apart in a longitudinal direction 94 of the apparatus from dogs 34 and 35. In accordance with this invention, any number of housings such as housings 40 and 41 may be provided.

In order to provide for adjustment of the position of each of the dogs 32 through 35 in a longitudinal direction 94 of the apparatus to compensate for differences in spacing of the anchor points 22 so that each dog 32 through 35 may consistently assume its proportionate share of the load for a power stroke during a jacking operation, the frame 80 is constructed to at least partially confine each of the housings 40 and 41 such that each of the housings 40 and 41 is individually movable longitudinally relative to the frame 80 within predetermined confines. Housings 40 and 41 are movable, as illustrated schematically in FIGS. 5 through 8, in a longitudinal direction 116 over a distance, illustrated at 106, equal generally to the equalizing cylinder piston stroke length. For example, this distance 106 may be about one-half inch.

Figure 4:
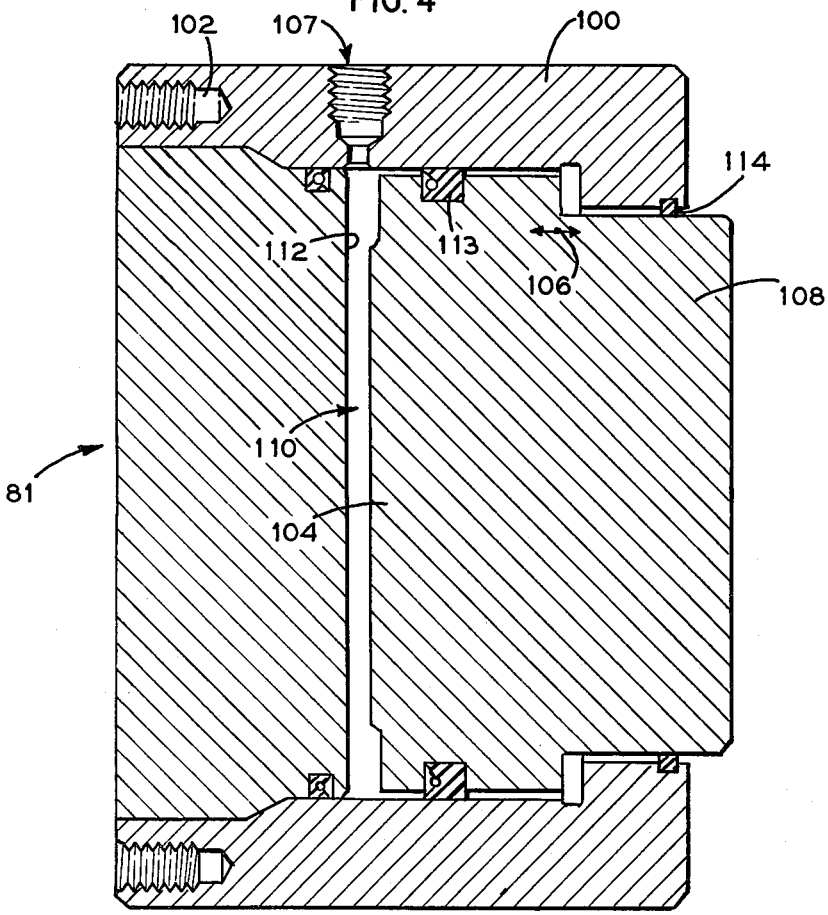
FIG. 4 is an enlarged section view of one of the equalizing cylinders shown in FIG. 1.

Each of the equalizing cylinders 81 through 92 is disposed between a housing 40 and 41 and a corresponding portion of the frame 80. An enlarged sectional view of one of the equalizing cylinders 81 is shown in FIG. 4, the other equalizing cylinders 82 through 92 being similar in structure. The equalizing cylinder 81 is provided with a body 100 rigidly attached to the frame 80 such as by fastening members 102 whereby the body 100 moves as a unit with the frame 80, a piston 104 movable in the body 100 and which has a piston stroke illustrated at 106 equal approximately to and preferably greater than the distance within the predetermined confines over which the respective housing 40 is movable longitudinally relative to the frame 80 (the piston 104 positioned at about mid-stroke in FIG. 4), a fluid inlet and outlet means 107, and a piston rod portion 108 which extends from the piston 104 to abut the respective housing 40 to provide movement thereof longitudinally within the predetermined confines in response to force transmitted through fluid contained within the equalizing cylinder space, illustrated at 110, between the piston 104 and cylinder wall 112. Conventional piston rings 113 and sealing means 114 may also be provided.

As shown in FIG. 1, the jacking apparatus 20 is provided with a first group of equalizing cylinders 81 through 86 to transmit the generated force to the housings 40 and 41 when it is applied by the frame 80 in the direction illustrated at 116 when dogs 32 through 35 are inserted into the respective housings 40 and 41 after being rotated 180° from the positions illustrated in FIG. 2. A second group of equalizing cylinders 87 through 92 are provided to transmit the generated force to housings 40 and 41 when it is applied by the frame in the direction illustrated at 118 when the dogs 32 through 35 are inserted into the respective housings 40 and 41 as illustrated in FIG. 2. However, in accordance with this invention, only one group equalizing cylinders need be provided. Although three equalizing cylinders of each group are provided between each housing and a corresponding portion of the frame so that the size requirements of an individual equalizing cylinder may be reduced, only one equalizing cylinder need be provided between each housing 40 and 41 and a corresponding portion of the frame 80 in accordance with this invention.

Figure 5:
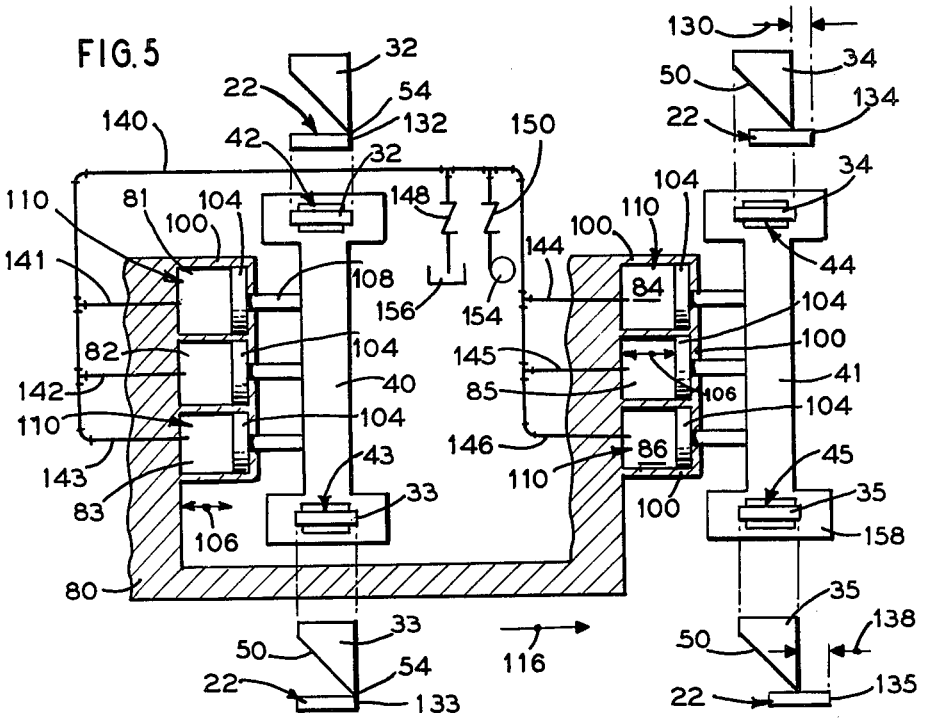
FIGS. 5 and 6 are schematics illustrating the principles of transmission of force to anchor points in accordance with one method of operation of the jacking apparatus.
Figure 6:
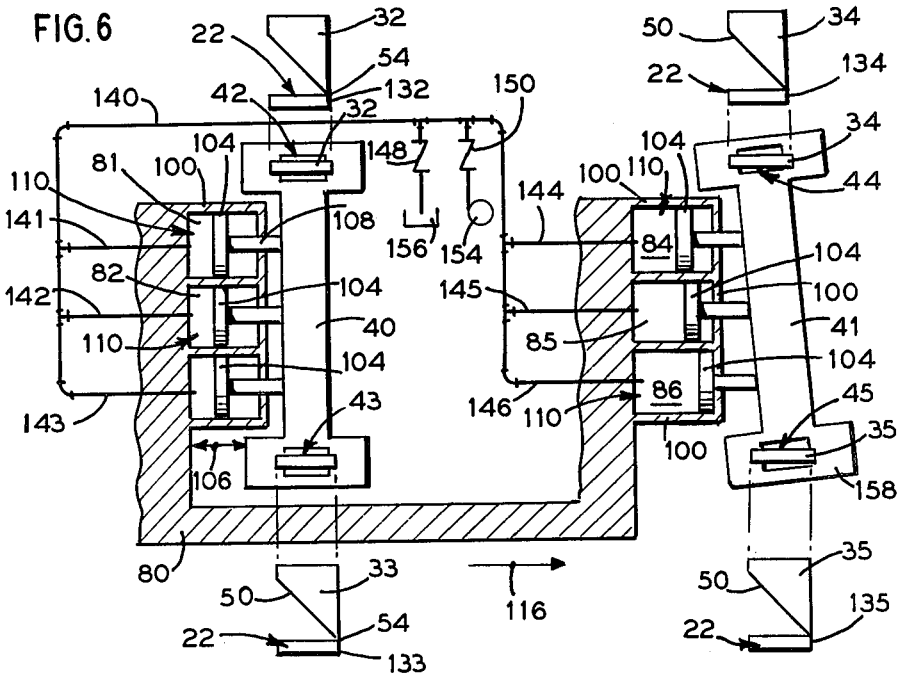

FIGS. 5 and 6 schematically illustrate the principles of a preferred method of operation of the force transmission means. Each of the dogs 32 through 35 is shown schematically and is again shown in elevation to illustrate its positions relative to respective anchor point edges 132 through 135 in FIGS. 5 and 6. FIG. 5 illustrates the positions of the dogs 32 through 35 relative to the respective anchor point edges 132 through 135 at a time when some of the dogs 32 and 33 are just beginning to engage respective anchor point edges 132 and 133 for a power stroke. It is desirable for all of the dogs 32 through 35 to engage the respective edges 132 through 135 so that each one will assume its share of the total load. However, anchor point edges 134 and 135 are illustrated as being located such that they are spaced too far from anchor point edges 132 and 133 for engagement by dogs 34 and 35 as long as housing member 41 is positioned relative to housing member 40 as illustrated. If there were no means provided for movement of housing 41 in the longitudinal direction 116 so that dogs 34 and 35 could engage the respective anchor point edges 134 and 135, then dogs 32 and 33 would transmit the total generated force only to anchor point edges 132 and 133 which force may then be so great as to deform or otherwise ruin the respective dogs and/or anchor points. Therefore, in accordance with this invention, in order to urge dogs 34 and 35 into engagement with anchor point edges 134 and 135, as illustrated in FIG. 6, such that each of the corresponding anchor points will assume its share of the total load, a means for limiting the fluid pressure in each of the group of equalizing cylinders 81 through 86 to a predetermined value is provided. This predetermined maximum pressure, which should of course be sufficient for movement of the load, is correlated to the maximum force which it is desired that each of the respective anchor point edges assume and may be determined by utilizing engineering principles of common knowledge to those of ordinary skill in the art to which this invention pertains. For example, in a typical jacking apparatus such as that shown in the drawings for movement of a large offshore oil platform, this predetermined maximum pressure may be 7200 lbs. per sq. in. (500 kg. per sq. cm.). The pressure limiting means may comprise a conduit such as line 141 which opens into the fluid space of an equalizing cylinder such as cylinder 81 and which is provided with a pressure relief valve set to open at the predetermined pressure for fluid flow from the respective equalizing cylinder. It is not necessary in accordance with the method of operation shown in FIGS. 5 and 6 that each of the equalizing cylinders 81 through 86 be in fluid communication with each other. However, it is preferred that each of the lines 141 through 146 be connected to each other for fluid communication therebetween such as through pipe 140 as shown in FIG. 5 in which case only one pressure relief valve 148 need be provided to relieve pressure whenever the pressure in the group of equalizing cylinders 81 through 86 exceeds the predetermined amount.

Referring to FIG. 5, the piston 104 in each of the equalizing cylinders 81 through 86 is extended the full length of the piston stroke 106 at the beginning of a power stroke.

Referring to FIG. 6, force transmitted through frame 80 in the direction illustrated at 116 results in the fluid pressure in equalizing cylinders 81 through 83 building up to the predetermined maximum pressure since housing 40 is prevented from movement in direction 116. This build-up in pressure causes relief valve 148 to open for flow of some of the fluid from the group of equalizing cylinders 81 through 86 to a sump 156 to limit the fluid pressure to the predetermined amount. The resulting decrease in fluid volume in the equalizing cylinders and lines allows the frame to be urged in longitudinal direction 116. Since housing 41 provides the least resistance to the application of the force through frame 80, the fluid volume will be decreased in equalizing cylinders 81 through 83 and movement of the repective cylinder bodies 100 in direction 116 relative to the respective pistons 104 of equalizing cylinders 81 through 83 will occur since the cylinder bodies are rigidly connected to the frame 80. Simultaneously and incrementally, the force applied by the frame 80 as it moves in direction 116 will act on the pistons 104 in equalizing cylinders 84 through 86 via the fluid therein to urge housing 41 in direction 116 the distance indicated at 130 until anchor point edge 134 is engaged by dog 34. In a similar manner, fluid pressure then continues to be relieved decreasing the fluid volumes in equalizing cylinders 81 through 85 and housing 41 is skewed slightly as illustrated in FIG. 6 as one end 158 is urged the distance indicated at 138 until anchor point edge 135 is engaged by dog 35. With each of the anchor point edges 132 through 135 engaged by the respective dogs 32 through 35, the force generated by cylinder structure 70 is distributed equally between the anchor point edges 132 through 135 for a power stroke.

In accordance with a preferred embodiment of this invention, in order to provide automatic repositioning of the pistons 104 after each power stroke, means are also provided for maintaining a predetermined minimum pressure in each of the equalizing cylinders 81 through 86. Although such means may comprise a separate line, check valve, and pump means for each equalizing cylinder, it is preferred, as illustrated in FIG. 5, that such means comprise a check valve 150 operable to provide fluid flow from pump means 154 into pipe means 140 for distribution to all of the equalizing cylinders 81 through 86 at the predetermined minimum pressure. Thus, during a repositioning stroke when substantial force is not being transmitted through frame 80 in direction 116, check valve 150 will open at least partially for fluid flow to the equalizing cylinders 81 through 86 until they are each again fully extended as illustrated in FIG. 5 and in position for another power stroke.

In a jacking apparatus such as that shown in the drawings wherein the predetermined maximum pressure is 7200 lbs. per sq. in. (500 kg. per sq. cm.), this predetermined minimum pressure may be 5000 lbs. per. sq. in. (350 kg. per sq. cm.) and may be determined by applying engineering principles of common knowledge to those of ordinary skill in the art to which this invention pertains.

Figure 7:
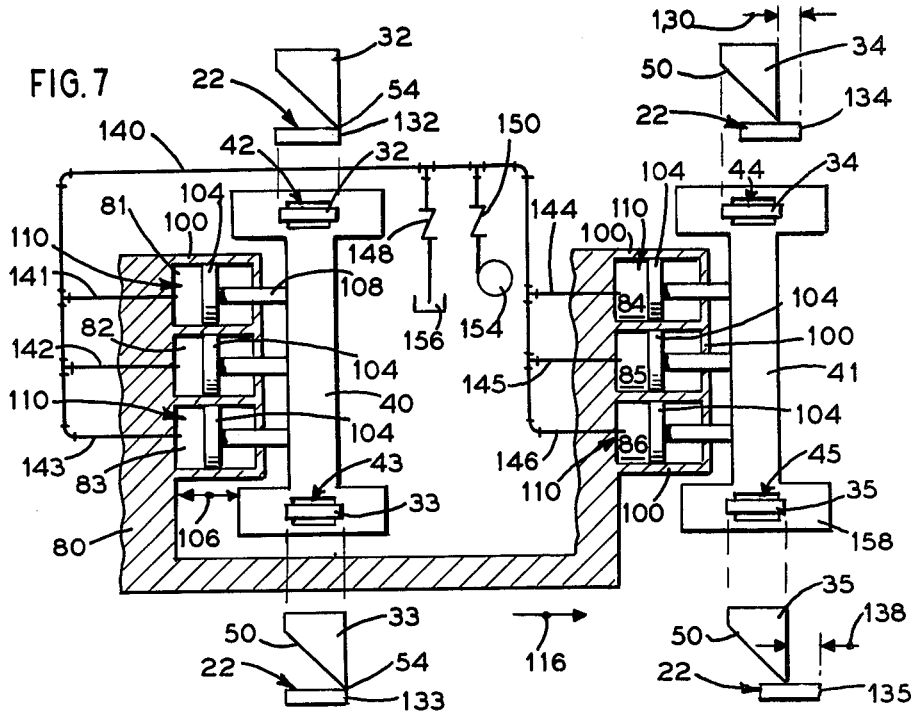
FIGS. 7 and 8 are schematics similar to those of FIGS. 5 an 6 illustrating the principles of transmission of force to anchor points in accordance with an alternative method of operation of the jacking apparatus.
Figure 8:
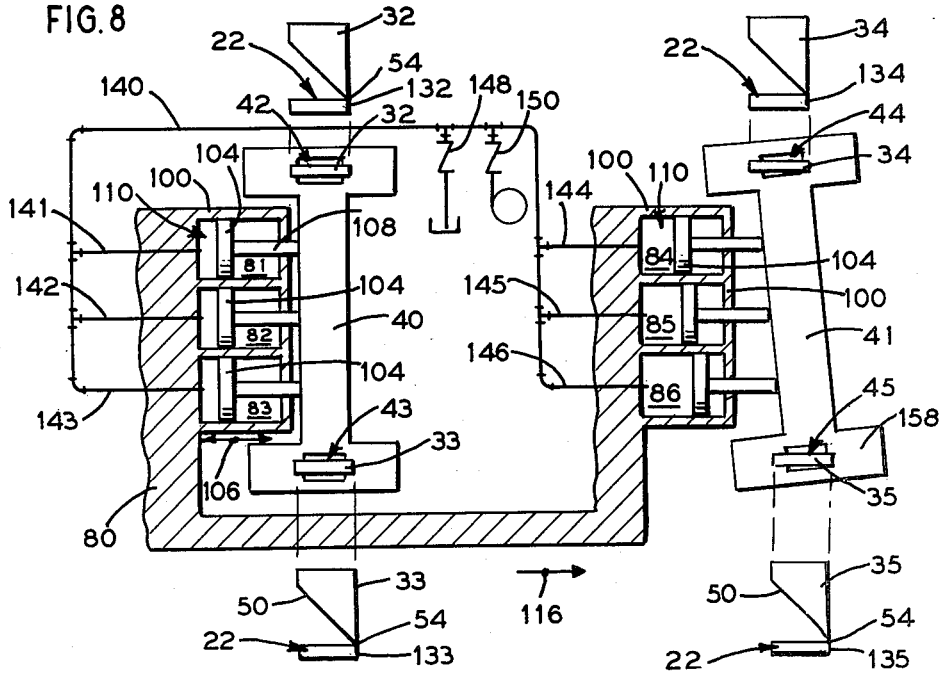

FIGS. 7 and 8 illustrate an alternative method of operating the jacking apparatus to achieve the same results illustrated in FIGS. 5 and 6. For this method of operation, means for equalizing the fluid pressure in the equalizing cylinders is provided. Such means preferably comprises piping means such as pipe 140 and branch lines 141 through 146 which open into the respective equalizing cylinders 81 through 86 for communication of hydraulic fluid pressure between the equalizing cylinders. Valves 148 and 150 may be provided but will generally remain normally closed during this method of operation.

Referring to FIG. 7, each of the piston 104 of equalizing cylinders 81 through 86 are positioned at the middle of or near the middle of their strokes 106 at the beginning of a power stroke and the equalizing cylinder fluid spaces and lines are filled with fluid.

Referring to FIG. 8, as force is applied to urge frame 80 in longitudinal direction 116, the fluid pressure in equalizing cylinders 84 through 86 will act on the respective pistons 104 to urge housing 41 in direction 116. Simultaneously and incrementally, fluid will flow from equalizing cylinders 81 through 83 through line 140 to equalizing cylinders 84 through 86 to fill the increased fluid space volume therein. The resulting decrease in fluid space volume in equalizing cylinders 81 through 83 allows movement of the frame 80 in direction 116 thus maintaining the fluid pressure in the equalizing cylinders for further incremental movement of housing 41 in direction 116. This cycle continues until anchor point edge 134 is engaged by dog 34. Then, in like manner, the pistons in equalizing cylinders 85 and 86 continue to urge the respective end 158 of housing 41 in direction 116 while hydraulic fluid flows from equalizing cylinders 81 through 84 to equalizing cylinders 85 and 86 until anchor point edge 135 is engaged by dog 35. With each of the anchor point edges 132 through 135 engaged by the respective dogs 32 through 35, the force generated by cylinder structure 70 is distributed equally between the anchor point edges 132 through 135 for a power stroke.

With this alternative method of operation of the jacking apparatus 20 illustrated in FIGS. 7 and 8, occasional repositioning of the equalizing cylinder pistons to mid-stroke may be required. However, if the piston stroke 106 is of sufficient length, such repositioning may not often be required. For example, anchor point edges may not usually be misaligned more than about one-eighth in. (3 mm.). In such a case, a piston stroke length 106 of one-half in. (13 mm.) is considered satisfactory.

Certain features of this invention may sometimes be used to advantage without a corresponding use of the other features. It is also to be understood that the invention is by no means limited to the specific embodiments which have been illustrated and described herein, and that various modifications thereof may indeed be made within the scope of the present invention as defined by the appended claims.

We claim:

1. A jacking apparatus comprising means for generating force for application against at least two anchor points which are spaced apart in a transverse direction of the apparatus for movement of a load, force transmission means including at least two equalizing cylinders for transmitting the generated force through fluid in said equalizing cylinders to the anchor points, and means for limiting the fluid pressure in each of said equalizing cylinders to a predetermined value, said force transmission means further includes a frame for transmitting the force from said force generating means to said equalizing cylinders, at least two anchor point engagement means which are spaced apart in said transverse direction, at least one member movable relative to said frame in a longitudinal direction of the apparatus and having at least two portions spaced apart in said transverse direction to which said anchor point engagement means are respectively engaged, said member portions are movable relative to each other in said longitudinal direction, and said equalizing cylinders are attached to said frame and disposed to engage said respective member portions to transmit the force from said frame to said respective member portions for movement thereof in said longitudinal direction relative to said frame and to each other.

2. A method for transmitting force for application equally against each of at least two anchor points for a stroke of a jacking apparatus wherein the at least two anchor points are spaced apart in a transverse direction of the apparatus, the method comprising:

a. transmitting the force to a frame;
b. transmitting the force from the frame to at least two equalizing cylinders;
c. transmitting the force through fluid in the equalizing cylinders to respective pistons;
d. transmitting the force from the pistons to respective transversely spaced portions of at least one member which is movable relative to the frame in a longitudinal direction of the apparatus and which portions are movable relative to each other in the longitudinal direction;
e. transmitting the force to the anchor points from the respective member portions; and
f. limiting the fluid pressure in each of the equalizing cylinders to a predetermined value.

3. A jacking apparatus comprising means for generating force for application against at least two anchor points which are spaced apart in a longitudinal direction of the apparatus for movement of a load, force transmission means including at least two equalizing cylinders for transmitting the generated force through fluid in said equalizing cylinders to the anchor points, and means for limiting the fluid pressure in each of said equalizing cylinders to a predetermined value, said force transmission means further includes a frame for transmitting the force from said force generating means to said equalizing cylinders, at least two anchor point engagement means which are spaced apart in said longitudinal direction, at least two members spaced apart in said longitudinal direction and movable relative to said frame and to each other in said longitudinal direction and to which said anchor point engagement means are respectively engaged, and said equalizing cylinders are attached to said frame and disposed to engage said respective members to transmit the force from said frame to said respective members for movement thereof in said longitudinal direction relative to said frame and to each other.

4. A method for transmitting force for application equally against each of at least two anchor points for a stroke of a jacking apparatus wherein the at least two anchor points are spaced apart in a longitudinal direction of the apparatus, the method comprising:

a. transmitting the force to a frame;
b. transmitting the force from the frame to at least two equalizing cylinders;
c. transmitting the force through fluid in the equalizing cylinders to respective pistons;
d. transmitting the force from the pistons to at least two members respectively which are spaced apart in the longitudinal direction and which are movable relative to the frame and to each other in the longitudinal direction;
e. transmitting the force to the anchor points from the respective members; and
f. limiting the fluid pressure in each of the equalizing cylinders to a predetermined value.

5. A jacking apparatus according to any one of claim 3 wherein said equalizing cylinders are positioned on respective first sides of said members to transmit force which is transmitted by said frame in a first longitudinal direction of the apparatus and the jacking apparatus further comprises another force transmission means including another group of equalizing cylinders positioned on respective second sides of said members to transmit force which is transmitted by said frame in a second longitudinal direction of the apparatus.

6. A jacking apparatus according to any one of claims 1 or 3 wherein said pressure limiting means comprises a relief valve in a line which opens into said equalizing cylinder.

7. A jacking apparatus according to claim 6 further comprising means for maintaining a predetermined minimum pressure in each of said equalizing cylinders.

8. A jacking apparatus according to claim 7 wherein said minimum pressure maintaining means includes a check valve operable to provide fluid flow into said equalizing cylinder at said predetermined minimum pressure.

9. A jacking apparatus according to claim 1 wherein said equalizing cylinders are disposed on a first side of said member to transmit force which is transmitted by said frame in a first longitudinal direction of the apparatus and the jacking apparatus further comprises another force transmission means including another group of equalizing cylinders disposed on a second side of said member to transmit force which is transmitted by said frame in a second longitudinal direction of the apparatus.

10. A jacking apparatus according to any one of claims 1 or 3 wherein said anchor point engagement means comprises a removable dog.

11. A jacking apparatus according to any one of claims 1 or 3 wherein each said equalizing cylinder comprises a body attached to said frame, a piston movable in said body, a piston rod portion extending from said piston to abut said respective member for movement thereof in response to fluid pressure in said equalizing cylinder.

12. A jacking apparatus according to any one of claims 1 or 3 wherein said force generation means comprises at least one hydraulic cylinder.

13. A jacking apparatus according to any one of claims 1 or 3 wherein said pressure limiting means includes means for equalizing the fluid pressure in said equalizing cylinders.

14. A jacking apparatus according to claim 13 wherein said equalizing means comprises piping means which opens into each of said equalizing cylinders for communication of hydraulic fluid pressure between said equalizing cylinders.

15. A jacking apparatus according to claim 14 wherein said pressure limiting means further includes a relief valve in said piping means.

16. A method according to claim 2 further comprising the step of maintaining a predetermined minimum fluid pressure in the equalizing cylinders.

17. A method according to any one of claims 2 or 4 further comprising equalizing the fluid pressure in the equalizing cylinders by providing a conduit for free flow of hydraulic fluid between the equalizing cylinders.

18. A jacking apparatus according to claim 1 wherein said force generating means includes means for generating force for application against at least two anchor points which are spaced apart in the longitudinal direction for movement of a load, said force transmission means includes at least two equalizing cylinders for transmitting the generated force through fluid therein to the longitudinally spaced apart anchor points, means for limiting the fluid pressure in each of said longitudinally spaced anchor point equalizing cylinders to a predetermined value, at least two anchor point engagement means which are spaced apart in said longitudinal direction, and at least two members spaced apart in said longitudinal direction and movable relative to said frame and to each other in said longitudinal direction and to which said longitudinally spaced anchor point engagement means are respectively engaged, and said longitudinally spaced anchor point equalizing cylinders are attached to said frame and disposed to engage said respective longitudinally spaced members for movement thereof in said longitudinal direction relative to said frame and to each other.

19. A method according to claim 2 wherein at least two anchor points are spaced apart in the longitudinal direction, the method further comprising: transmitting the force from the frame to at least two equalizing cylinders for the at least two longitudinally spaced anchor points; transmitting the force through fluid in the longitudinally spaced anchor point equalizing cylinders to respective postions; transmitting the force from the pistons of the longitudinally spaced anchor point equalizing cylinders to at least two members respectively which are spaced apart in the longitudinal direction and which are movable relative to the frame and to each other in the longitudinal direction; transmitting the force to the longitudinally spaced anchor points from the respective longitudinally spaced members; and limiting the fluid pressure in each of the longitudinally spaced anchor point equalizing cylinders to a predetermined value.

* * * * *